US007541908B2

(12) United States Patent
Kitahara et al.

(10) Patent No.: US 7,541,908 B2
(45) Date of Patent: Jun. 2, 2009

(54) TRANSFORMER

(75) Inventors: Satoru Kitahara, Tokyo (JP); Shigeru Kaneko, Tokyo (JP)

(73) Assignee: TDK Corporation, Tokyo (JP)

( * ) Notice: Subject to any disclaimer, the term of this patent is extended or adjusted under 35 U.S.C. 154(b) by 427 days.

(21) Appl. No.: 11/286,375

(22) Filed: Nov. 25, 2005

(65) Prior Publication Data

US 2006/0132272 A1 Jun. 22, 2006

(30) Foreign Application Priority Data

Nov. 30, 2004 (JP) ..... 2004-345188

(51) Int. Cl.
*H01F 27/30* (2006.01)

(52) U.S. Cl. ..... 336/206

(58) Field of Classification Search ..... 336/65, 336/90–96, 200, 205–208, 180–186
See application file for complete search history.

(56) References Cited

U.S. PATENT DOCUMENTS 5,844,461 A * 12/1998 Faulk et al. ..... 336/206
6,296,935 B1 * 10/2001 Higashiura et al. ..... 428/373

FOREIGN PATENT DOCUMENTS

CN 2381003 Y 5/2000
JP 1-308472 12/1989
JP 2168607 6/1990
JP 7-326525 12/1995
JP 08-051035 2/1996
JP 08-097053 4/1996
JP 9-330826 12/1997
JP 10-125140 5/1998
JP 2004-47731 A 2/2004
WO WO 99/19885 4/1999
WO WO 02/099821 A1 12/2002
WO WO 2005/106898 A1 11/2005

* cited by examiner

*Primary Examiner*—Tuyen T. Nguyen
(74) *Attorney, Agent, or Firm*—Oblon, Spivak, McClelland, Maier & Neustadt, P.C.

(57) ABSTRACT

A pair of flanges 16 are formed on both ends of a spool 14 of a bobbin 12, and an insulation layer 32 formed by heat curing an interlayer insulation prepreg tape 22 is formed on the external periphery of the spool 14. A primary coil 26 is wound on the external periphery of the insulation layer 32, and a secondary coil 28 is wound on the external periphery of the primary coil 26. Insulation layers 32 are provided respectively between the primary coil 26 and the secondary coil 28, and on the external periphery of the secondary coil 28. Insulation layers 34 formed by heat curing an inner wall insulation prepreg tape 24 are provided on mutually opposed faces 16A of the paired flanged 16, and such insulations layers 32 and 34 have a mutually linked structure.

7 Claims, 6 Drawing Sheets

TRANSFORMER

BACKGROUND OF THE INVENTION

1. Field of the Invention

The present invention relates to a transformer capable of achieving a compact structure by increasing a coil occupancy within a wiring frame without increasing a production cost, and more particularly to a transformer utilizing a prepreg tape for insulation.

2. Discussion of the Background

In a transformer employed in a power source such as a switching regulator, an insulation structure in prior technology is generally classified into following three types, which are suitably selected according to the application or the required performance.

A first insulation structure is a tape insulation structure. In this structure, two coils respectively wound circumferentially on a bobbin are mutually insulated by an insulation tape which is likewise wound circumferentially on the bobbin.

A second insulation structure is based on a divided bobbin. In such structure, a flange is provided also within a spool of a bobbin, and the coils are mutually insulated by being separately wound on spool portions separated by the flange. A third insulation structure is based on resin molding. In this structure, two coils are mutually insulated by filling a gap of the two coils, constituting different poles, with a resin.

In the first insulation structure, however, though the adjacent coils of different poles are mutually insulated by the insulation tape, a barrier tape or the like has to be provided on end faces of the coils in order to secure a creepage distance or a spatial distance required for safety standards, thus resulting in a portion where the coils cannot be provided. As a result, the occupancy ratio of the coils within the spool becomes lower, leading to a larger dimension of the transformer.

Also the second insulation structure based on the divided bobbin requires a portion where the coils cannot be provided as in the case of the first insulation structure, whereby the occupancy ratio of the coils within the spool becomes lower, leading to a larger dimension of the transformer.

On the other hand, the third insulation structure based on the resin molding is not associated with the drawback of the larger dimension of the transformer as in the first or second insulation structure, but it requires a special equipment in the production process of the transformer and also requires a long time for the resin curing, thus involving an increased production cost.

On the other hand, a prepreg tape is employed in a structure described in JP-A No. 9-330826 described above, but such structure is associated with a drawback of being in capable of securing a creepage distance or a spatial distance between a primary coil and a secondary coil or between a higher voltage coil and a lower voltage coil required for the safety standards.

SUMMARY OF THE INVENTION

In consideration of the foregoing situation, an object of the present invention is to provide a transformer capable of realizing a smaller dimension by increasing an occupancy ratio of the coils within a spool, without involving an increase in the production cost.

According to first aspect of the invention, a transformer includes: a bobbin having a spool and a pair of flanges positioned on both ends of the spool; two or more coils wound in superposition on the spool; and an insulation layer formed by curing an insulation tape constituted of an epoxy resin coated on a support material; wherein the insulation tape is provided respectively on mutually opposed faces of the paired flanges and also respectively on an internal periphery and an external periphery of at least one of the two or more coils, and such insulation tapes are cured to constitute an insulation layer covering the at least one coil.

The transformer described has a structure in which two or more coils are wound in superposition on a spool of a bobbin. In this structure, an insulation tape, formed by coating an epoxy resin on a support material, is provided respectively on mutually opposed faces of the paired flanges provided on both ends of the spool and also respectively on an internal periphery and an external periphery of at least one of the two or more coils.

Therefore, a prepreg tape, for example an epoxy-impregnated tape, as an insulation tape is provided not only on internal walls constituting mutually opposed faces of the flanges of the bobbin, contacted by the end portions of the two coils but also on the internal and external peripheries of at least one of the two coils whereby all the periphery of a coil is covered by the insulation tape.

Thus, according to the present invention, the insulation tape is present on the end portions of the two coils and on the internal and external peripheries constituting the periphery of a coil, and such insulation tape is heated to fuse and then cure the insulating epoxy resin of the insulation tape thereby forming an epoxy resin and thus constructing an insulation layer. As a result, thus formed epoxy resin forms connected insulation layers and is filled around a coil, whereby the coil layer assumes a structure totally enclosed by the insulation layer and the coils are mutually insulated.

Therefore the transformer of the present invention, assumes a structure not including a creeping surface or a space between the two coils of the different poles, whereby the creepage distance or the spatial distance for which the insulating distance is defined in the safety standards does not exist, and the insulation between the different poles is dependent solely on the dielectric strength of the employed insulation layer.

As a result, in contrast to the prior structure based on the resin molding, the transformer of the present invention can secure the insulation between two coils by a thin insulation layer formed by curing the insulation tape, without increasing the production cost. Consequently, in comparison with the case where the creepage distance has to be secured by a barrier tape, an area where the coil cannot be formed within the spool of the bobbin can be reduced thereby allowing to increase the occupancy ratio of the coil in the spool of the bobbin and to achieve a smaller dimension of the transformer.

A transformer of the second aspect of the invention has a configuration that the insulation tape is a prepreg tape formed by coating an epoxy resin on a surface of a polyester tape.

Therefore, the epoxy resin coated on a surface of the polyester tape constituting a substrate is fused, upon heating of the insulation tape, then easily cured and forms a mutual connection of the epoxy resin to connect the adjacent insulation tapes thereby more securely exhibiting the above described effect.

Furthermore, a transformer may has a configuration that the insulation tape is constituted of a prepreg tape of a three-layered structure formed by coating an epoxy resin on a surface of a polyester tape, and coating a tacky material on the epoxy resin.

Therefore, as the insulation tape is constituted of a three-layered prepreg tape including a tacky material in which the epoxy resin is sandwiched between the tacky material and the polyester tape, the epoxy resin is fused upon heating and is cured in a state where the epoxy resin penetrates into the layer of the tacky material, whereby the insulation layer is formed not only by the epoxy resin but also the tacky material and the wire winding operation is also facilitated.

Furthermore, a transformer may has a configuration that the insulation tape is constituted of a prepreg tape of a three-layered structure formed by coating an epoxy resin on a surface of a polyester tape, and coating a tacky material on the other surface of the polyester tape.

Therefore, as the insulation tape is constituted of a three-layered prepreg tape including a tacky material, the insulation tape can be easily adhered by the tacky material onto the flanges of the bobbin. Also the epoxy resin, provided on a surface of the polyester tape, is fused upon heating and is then cured and can be easily connected with the epoxy resin of another insulation tape.

Preferably, a transformer may has a configuration that the polyester tape is constituted of a multilayer polyester film tape, for example, a three-layered structure. Consequently, the polyester tape constituted of a polyester film tape of a three-layered structure may be wound by a turn as an external layer of the coil thereby meeting the dielectric strength required by the safety standards.

The present invention allows to obtain a transformer made in a smaller dimension, by increasing the occupancy ratio of the coil within the spool, without increasing the production cost.

BRIEF DESCRIPTION OF THE DRAWINGS

FIGS. 6A and 6B are cross-sectional views showing comparison of a space in a bobbin of a transformer, wherein FIG. 6A shows a principal cross section of a transformer embodying the present invention, and FIG. 6B shows a principal cross section of a transformer of a prior technology.

DETAILED DESCRIPTION OF THE PREFERRED EMBODIMENTS

Figure 1:
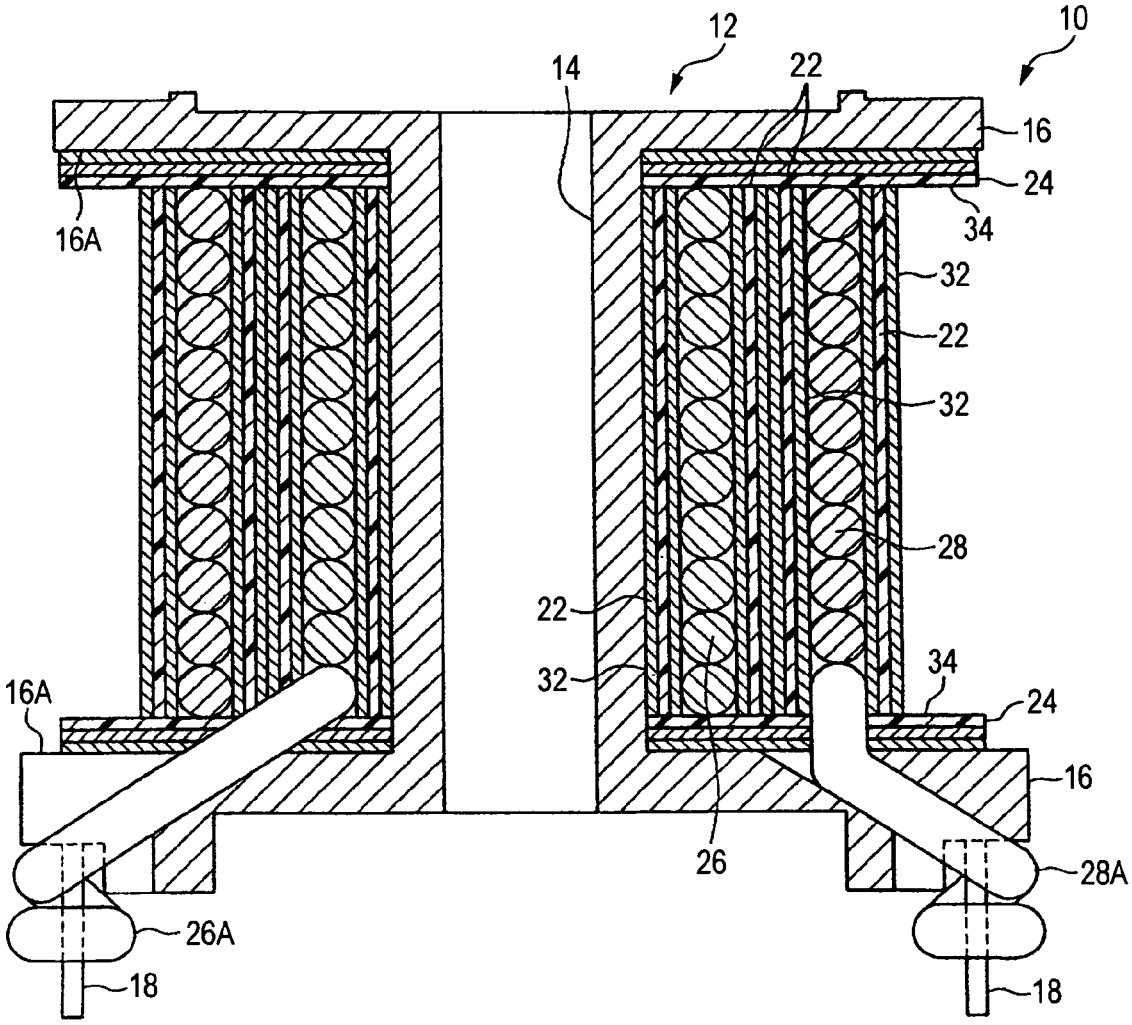
FIG. 1 is a cross-sectional view showing a transformer of an embodiment of the present invention, in a state where a ferrite core is removed.
Figure 2:
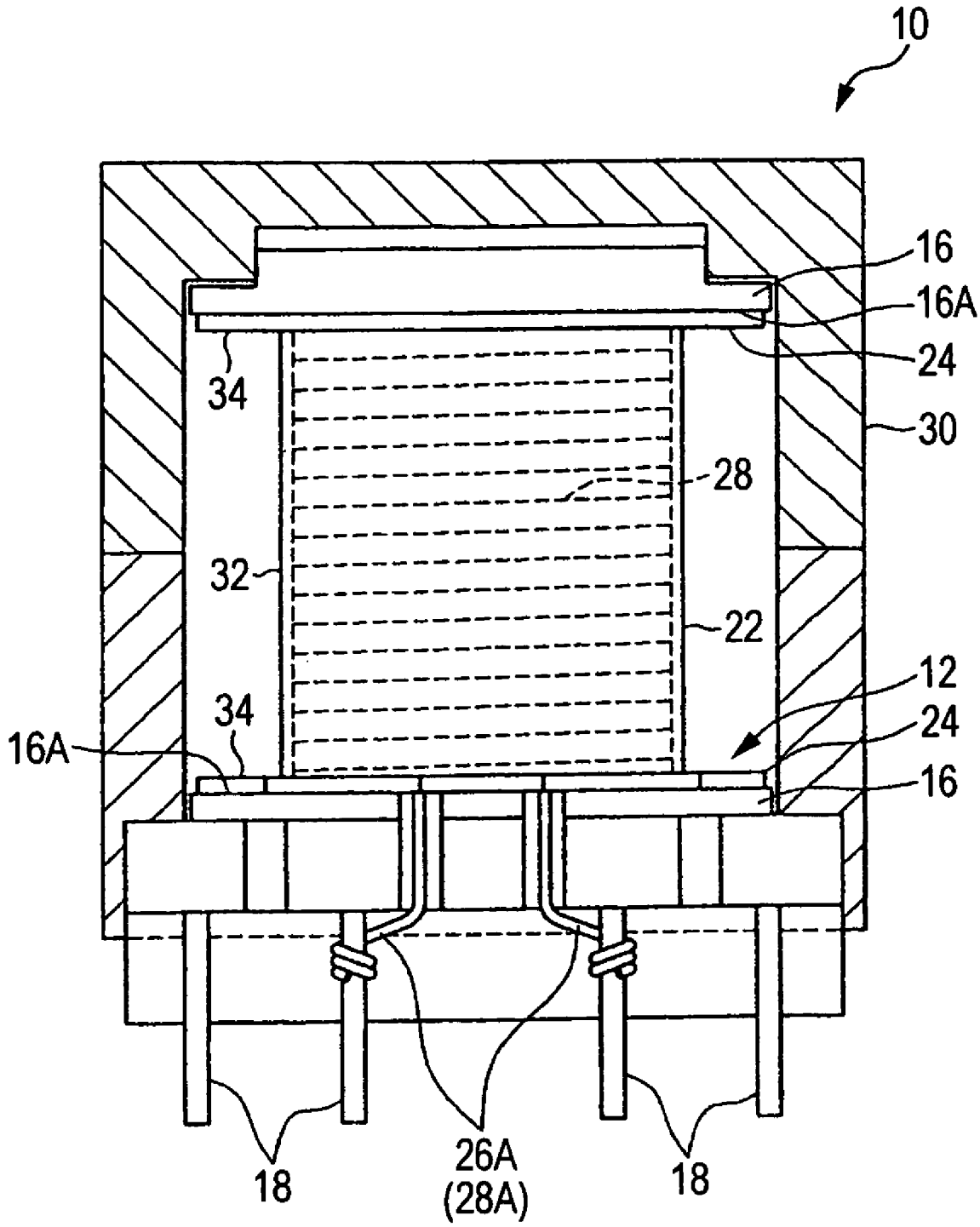
FIG. 2 is a lateral view of a transformer of an embodiment of the present invention.
Figure 3:
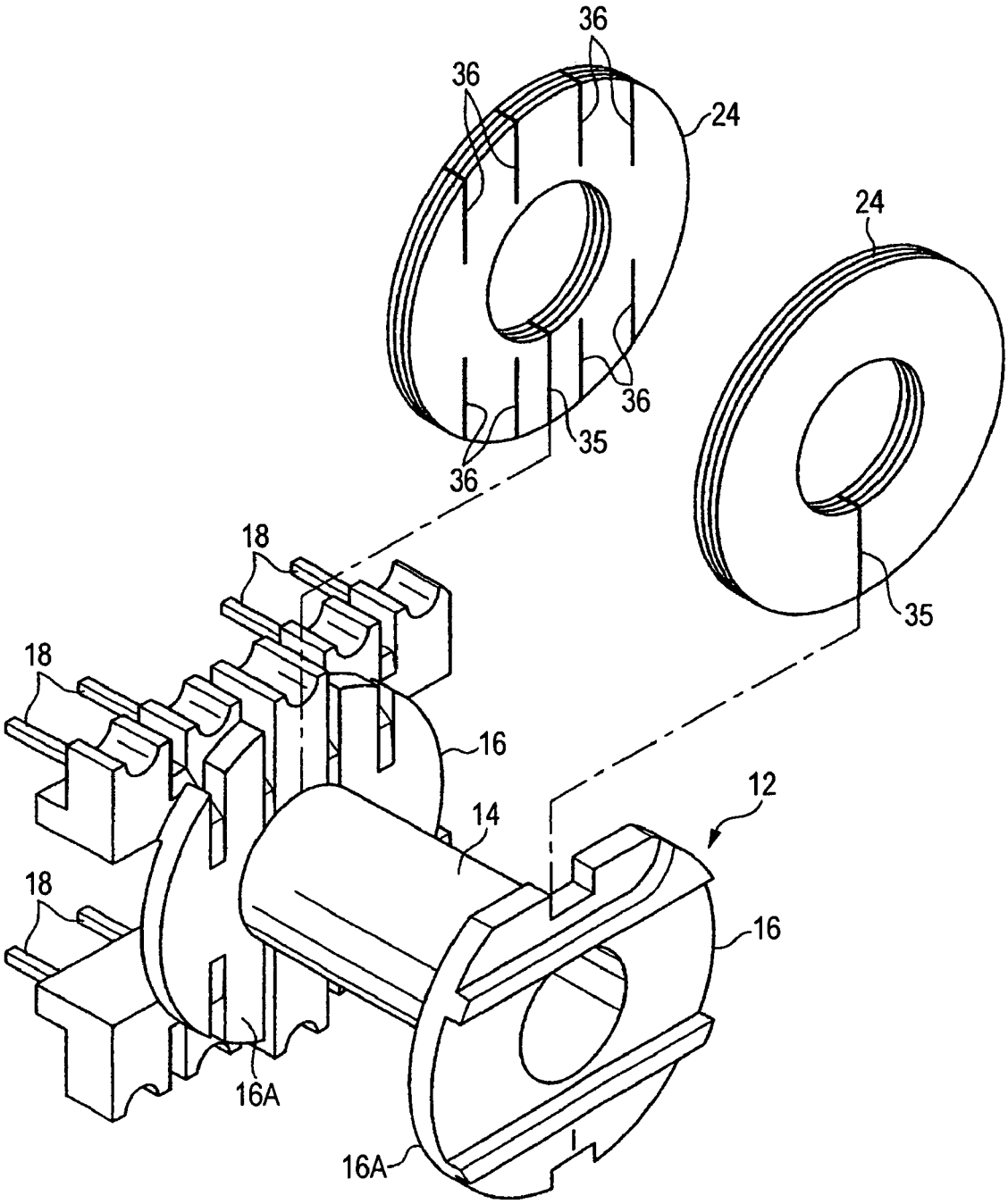
FIG. 3 is an exploded perspective view showing a bobbin and an inner wall insulating prepreg tape constituting a transformer in an embodiment of the present invention.
Figure 4:
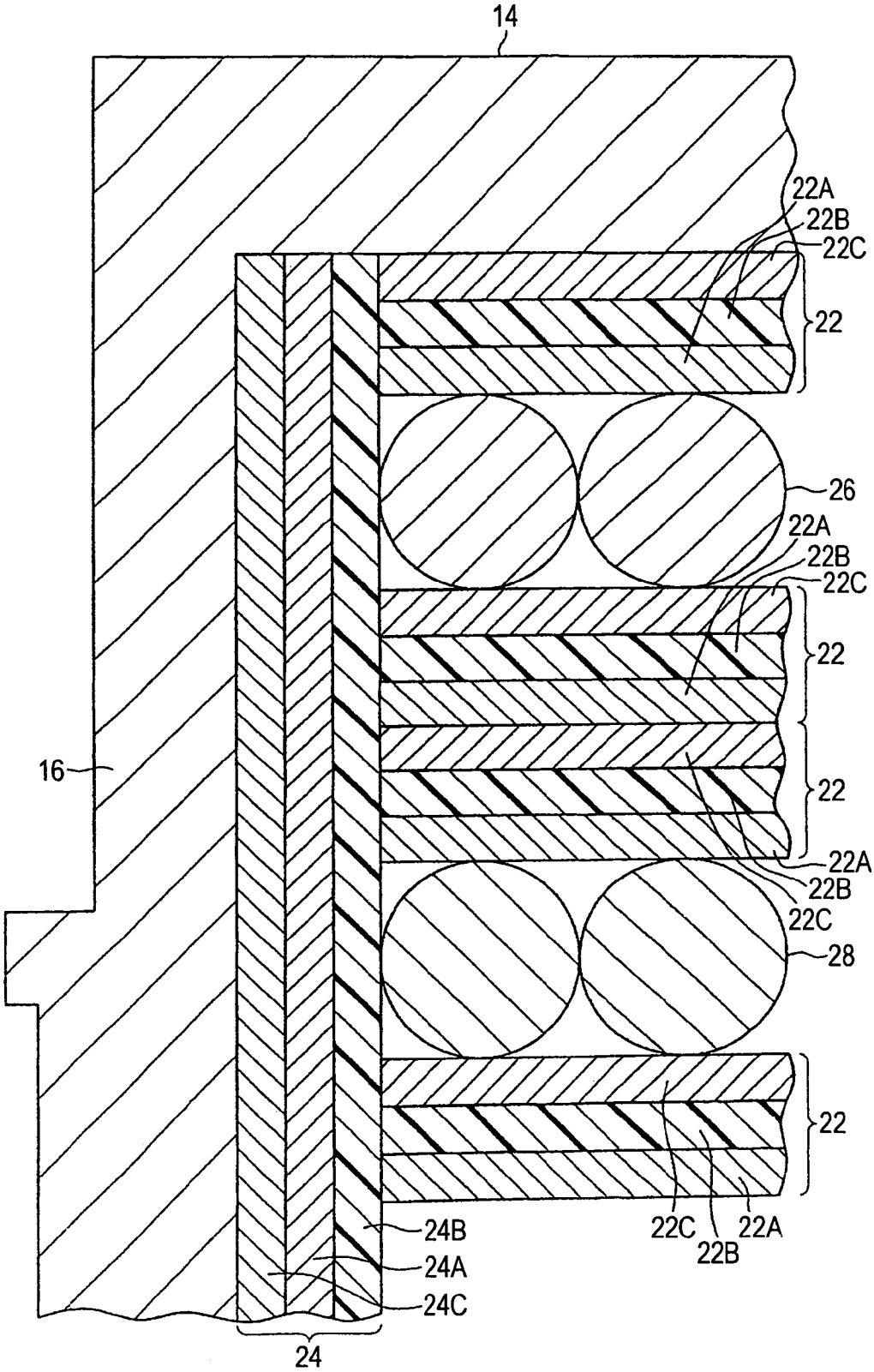
FIG. 4 is a magnified cross-sectional view showing a principal part of the transformer shown in FIG. 1, in a state prior to heat curing.

In the following, an embodiment of the transformer of the present invention will be shown in FIGS. 1 to 5, and will be explained with reference to these drawings. As shown in FIGS. 1 to 3, a bobbin 12 of a transformer 10 of the present embodiment is provided with a spool 14 formed into a cylindrical shape, and a pair of flanges formed on both ends of the spool 14. One of the flanges 16 is provided with plural terminals 18 of which base ends are embedded in such flange 16.

As shown in FIG. 1, on the external periphery of the spool 14, there is provided an insulation layer 32 which is formed by heat curing an interlayer insulation prepreg tape constituting a first insulation tape. On the external peripheral side of the insulation layer 32, a primary coil 26 is wound, and a secondary coil 28 is wound on the external periphery of the primary coil 26. Leads 26A, 28A on both ends of these primary and secondary coils are respectively mounted on the terminals 18.

Between the primary coil 26 and the secondary coil 28 and on the external periphery of the secondary coil 28, there are respectively provided insulation layers 32, each formed by heat curing the interlayer insulation prepreg tape 22. Thus, in the present embodiment, between three concentric insulation layers 32 of different diameters, the primary coil 27 and the secondary coil 28 are provided in likewise concentric manner with different winding diameters.

On the other hand, as shown in FIGS. 1 to 3, on mutually opposed faces 16A of the paired flanges 16, there are provided insulation layers 34, each formed by heat curing an inner wall insulating prepreg tape 24 constituting a second insulation tape. In the present embodiment, therefore, the insulation layers 32 are present between the primary coil 26 and the secondary coil 28 and in the internal and external peripheries of such primary and secondary coils 26, 28, and also the insulation layers 34 are present on both end portions of the primary and secondary coils 26, 28, and such insulation layers 32 and 34 have a mutually connected structure.

On the bobbin 12 on which the primary and secondary coils 26, 28 are wound and the insulation layers 32, 34 are formed as described above, a ferrite core 30 is provided as shown in FIG. 2 to constitute the transformer 10 of the present embodiment.

The interlayer insulation prepreg tape 22 has a three-layered structure formed by coating an epoxy resin 22B on a surface of a polyester tape 22A constituting a substrate and further coating a tacky material 22C on the epoxy resin. The polyester tape 22A has a thickness for example of 12 to 50 μm, and the epoxy resin 22B has a thickness for example of 10 to 20 μm.

The inner wall insulating prepreg tape 24 has a three-layered structure with same materials but different in the order of lamination thereof, and is formed by coating an epoxy resin 24B on a surface of a polyester tape 24A and coating a tacky material 24C on the other surface, whereby the polyester tape 24A is sandwiched between the epoxy resin 24A and the tacky material 24C. The polyester tape 24A has a thickness for example of 12 to 50 μm, and the epoxy resin 24B has a thickness for example of 0.4 mm or larger.

Furthermore, a polyester film tape having a multiple layered structure having at least two layers can be used as the polyester tape of the prepreg tape. In this case, the multilayer polyester film tape has a thickness for example 12 to 50 μm.

In a case of where a safety standard requires more than three layers of polyester tape in order to enhance an insulation withstand voltage, thickness of the insulation layer is increased if the prepreg tape is wound three turns. This is not desirable to the miniaturization or the improvement in the characteristic in a transformer. When the polyester tape is made of a polyester film tape having three layer structure, three layers of polyester tape is achieved by one turn of the prepreg tape. Thus, the withstand voltage is enhanced without increasing the thickness of the insulation layer. Additionally, a prepreg tape including a two layers structure polyester film tape and a prepreg tape including a single layer polyester tape may be stacked to achieve three layers of the polyester tape. Moreover, a polyester film tape having four layers structure may be used for the prepreg tape.

In the following there will be explained a production procedure of the transformer 10 of the present embodiment.

At first, prior to starting the wire winding, an inner wall insulation prepreg tape 24 having an insulation function is adhered by the tacky material 24C onto the opposed faces 16A of the paired flanges 16 of the bobbin 12 as shown in FIGS. 1 and 3. Then an interlayer insulation prepreg tape 22 having a similar insulating function is adhered by the tacky material 22C and wound by one layer on the spool 14 of the bobbin 12.

As shown in FIG. 3, the paired inner wall insulation prepreg tapes 24 are formed in an annular shape matching the shape of the flange 16 of the bobbin 12, but are provided with a notch 35 for passing the spool 14, and notches 36 for passing lead wires 26A, 28A of the primary and secondary coils 26, 28.

Then the primary coil 26 is wound on the spool 14 over the interlayer insulation prepreg tape 22, and, after the lead wires 26A are bound on the terminals 18, the interlayer insulation prepreg tape 22 is wound by a necessary number of layers (two layers in the present embodiment) under sticking by the tacky material 22C. Thereafter the secondary coil 28 is wound thereon, like the primary coil 26, onto the spool 14, and, after the lead wires 28A are bound on the terminals 18, the interlayer insulation prepreg tape 22 is wound thereon to attain a state shown in FIG. 4.

In this state, the bobbin 12 is heated for example for about 60 to 120 minutes at 120° C. thereby fusing and then curing the epoxy resins 22B, 24B of the prepreg tapes 22, 24. Through this process, the insulations layers 32 and 34 are mutually linked, and the primary coil 26 and the secondary coil 28 are respectively surrounded by the insulation layers 32, 34 containing the cured epoxy resin.

Thereafter, the ferrite core 30 is placed over the bobbin 12 in a state where the primary coil 26 and the secondary coil 28 are respectively surrounded by the insulation layers 32, 34 thereby completing the transformer shown in FIG. 2.

In the following there will be explained the function of the transformer 10 of the present embodiment.

The transformer 10 of the present embodiment has a structure in which two coils, namely the primary and secondary coils 26, 28, are wound in superposed manner on the spool 14 of the bobbin 12. The structure also includes the prepreg tapes 22, 24, which are insulation tapes formed by coating epoxy resin on a polyester tape, positioned respectively on the opposed faces 16A of the pair of flanges 16 provided at both ends of the spool 14, and also between the primary and secondary coils 26, 28 and on the internal and external peripheries of the primary and secondary coils 26, 28.

Therefore, because of the presence of the prepreg tapes 22, 24 not only on the opposed faces 16A of the flanges 16 which are in contact with the end portions of the primary and secondary coils 26, 28 but also between the primary and secondary coils 26, 28 and on the internal and external peripheries of the primary and secondary coils 26, 28, all the perimeters of the primary and secondary coils 26, 28 are respectively covered by the prepreg tapes 22, 24.

In the present embodiment, the prepreg tapes 22, 24 are respectively present on the end portions of the primary and secondary coils 26, 28, and between the primary and secondary coils 26, 28 and on the internal and external peripheries thereof, and such prepreg tapes 22, 24 are heat cured whereby the epoxy resins 22B, 24B of the prepreg tapes 22, 24 are once fused and then cured to constitute an epoxy resin, thereby forming the insulation layers 32, 34.

Figure 5:
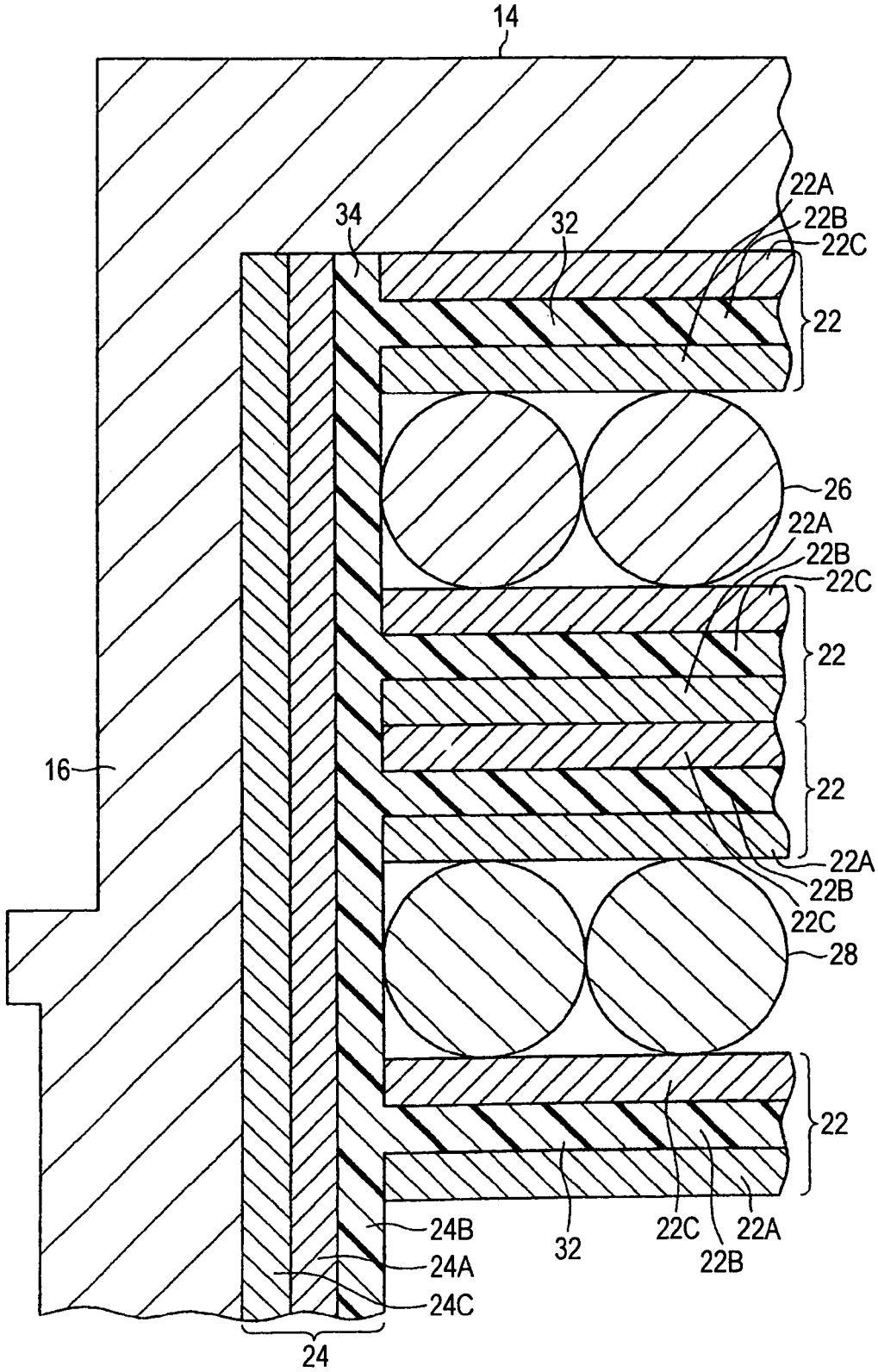
FIG. 5 is a magnified cross-sectional view showing a principal part of the transformer shown in FIG. 1, in a state after heat curing.

As a result, such epoxy resin is filled around the primary and secondary coils 26, 28 while connecting the insulation layers 34 and the insulation layers 35 as shown in FIG. 5, whereby the coils 26, 28 are respectively completely enclosed by the insulation layers 32, 34 and are mutually insulated.

Consequently, the transformer of the present embodiment assumes a structure not including a creeping surface or a space between the two coils 26, 28 of the different poles, whereby the creepage distance or the spatial distance for which the insulating distance is defined in the safety standards does not exist, and the insulation between the different poles is dependent solely on the dielectric strength of the employed insulation layers 32, 34. Therefore, there are only defined the thickness of the insulation layers 32, 34, and the dielectric strength and the number of winding turns when the insulation layers 32, 34 are formed by a tape.

As a result, in contrast to the prior structure based on the resin molding, the present embodiment can secure the insulation between the primary and secondary coils 26, 28 by the thin insulation layers 32, 34 formed by curing the prepreg tapes 22, 24, without increasing the production cost of the transformer 10.

Consequently, in comparison with the case where the creepage distance is secured by a barrier tape employed in the prior technology, an area where the coil cannot be formed within the spool 14 of the bobbin 12 can be reduced thereby allowing to increase the occupancy ratio of the coil in the spool 14 of the bobbin 12 and to achieve a smaller dimension of the transformer 10.

Besides, in the present embodiment, the insulating epoxy resins 22B, 24B coated on and impregnated in the prepreg tapes 22, 24 are cured after being filled between the primary and secondary coils 26, 28 at the heating, thereby improving conduction for the heat generated by the copper loss of the coils, and such effect also contributes to the dimensional reduction of the transformer 10. Also as the coils can be wound over the entire width of the spool 14 of the bobbin 12, a coupling between the primary and secondary coils 26, 28 can also be improved to obtain an improved efficiency when the transformer 10 of the present embodiment is operated as a power source.

On the other hand, in the present embodiment, the interlayer insulation prepreg tape 22 has a three-layered structure formed by coating the epoxy resin 22B on a surface of the polyester tape 22A constituting the substrate and further coating a tacky material 22C on the epoxy resin 22B.

In the present embodiment, therefore, because of the presence of the epoxy resin 22B coated on the surface of the polyester tape 22A, such epoxy resin 22B is once fused and then easily cured upon heating of the interlayer insulation prepreg tape 22 and is connected with the epoxy resin 24B, positioned adjacent to the epoxy resin 22B, whereby the adjacent prepreg tapes 22, 24 are mutually connected easily as shown in FIG. 5.

Also because of the three-layered structure in which the epoxy resin 22B is sandwiched between the tacky material 22C and the polyester tape 22A, the epoxy resin 22B is fused upon heating and is cured in a state where the epoxy resin penetrates into the layer of the tacky material 22C, whereby the insulation layer is formed not only by the epoxy resin 22B but also the tacky material 22C.

On the other hand, in the present embodiment, the inner wall insulation prepreg tape 24 has a three-layered structure formed by coating the epoxy resin 24B on a surface of the polyester tape 24A constituting the substrate and coating the tacky material 24C on the other surface.

In the present embodiment, therefore, the inner wall insulation prepreg tape 24 of such three-layered structure employed as the insulation tape allows to easily apply the inner wall insulation prepreg tape 24 onto the flanges 16 of the bobbin 12, by adhering the inner wall insulation prepreg tape 24 by the tacky material 24C to the flanges 16 of the bobbin 12. Also the epoxy resin 24B provided on a surface of the polyester tape 24A is once fused upon heating and then cured and can therefore be easily connected to the epoxy resin 22B of the interlayer insulation prepreg tape 22.

Figure 6A:
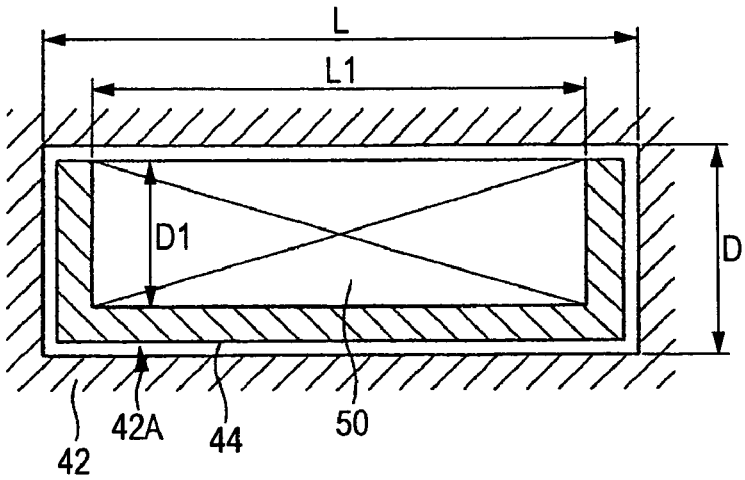

In the following, a space in the bobbin of the transformer embodying the present invention will be explained in comparison with a space in a bobbin of a transformer by the prior technology. FIG. 6A is a cross-sectional view showing principal parts of a transformer embodying the present invention, while FIG. 6B is a cross-sectional view showing principal parts of a transformer matching the European safety standards.

Figure 6B:
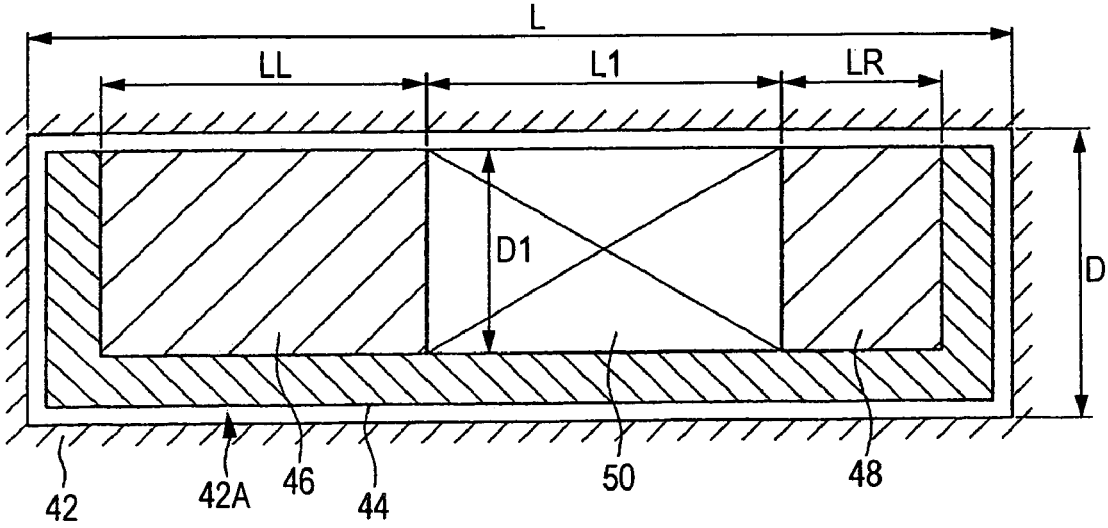

In the prior technology matching the aforementioned safety standards as shown in FIG. 6B, a bobbin 44 having a space for winding a coil 50 is positioned within a window 42A of a ferrite core 42. The window 42A of the ferrite core 42 has a length L of 19.3 mm and a width D of 5.9 mm, and therefore an area 5.9×19.3=11.3 mm2.

Also an area, closer to the terminal side (left hand side in the drawing) of the bobbin 44, in which the coil cannot be wound because of the presence of a barrier tape 46 has a length LL of 6.4 mm, while an area, opposite to the terminal side (right hand side in the drawing) of the bobbin 44, in which the coil cannot be wound because of the presence of a barrier tape 48 has a length LR of 3.2 mm.

Thus, the coil 50 can be provided in a remaining area which has a length L1 of 7.1 mm and a width D1 of 4.3 mm. In this example, therefore, the area in which the coil 50 can be provided has an area of 4.3×7.1=30.5 mm2 and has an occupancy rate of about 27% only of the window area of the ferrite core 42.

On the other hand, FIG. 6A shows a transformer embodying the present invention, in which an area where the coil 50 can be provided may have a length L1 of 10.0 mm and a width D1 of 3.05 mm in order to secure a same area of 30.5 mm2.

It is therefore possible to form the ferrite core 42 with the window 42A of a length L of 12.0 mm and a width D of 4.15 mm, namely with a window area of 4.15×12=49.8 mm2, whereby the occupancy rate of the area where the coil 50 can be provided is improved to 61%. Consequently, in the transformer embodying the present invention, the window area of the ferrite core 42 can be reduced to 44% of the window area in the ferrite core 42 in the transformer of the prior technology.

In the above-described embodiment, the insulation tape constituting the prepreg tape has a structure of coating epoxy resin on a surface of a polyester tape as the substrate, but there may also be employed a structure of impregnating a substrate of a woven or non-woven cloth with epoxy resin or further coating a tacky material thereon, and also a non-woven cloth or the like of a glass material may be employed as the substrate.

In the foregoing embodiment, the secondary coil is wound on the external periphery of the primary coil, but it is also possible to employ an inverted structure of winding the primary coil on the external periphery of the secondary coil, and the present invention may also be applied to a transformer having a high voltage coil and a low voltage coil. Also the foregoing embodiment assumes two coils, but the present invention may also be applied to a transformer having three or more coils.

On the other hand, the foregoing embodiment employs two insulation tapes, namely the interlayer insulation prepreg tape 22 and the inner wall insulation prepreg tape 24 which are mutually different in the arrangement of the epoxy resin and the tacky material, but it is also possible to use an insulation tape only by utilizing the inner wall insulation prepreg tape 24 also in the locations where the interlayer insulation prepreg tape 22 is used. Also the present invention has been explained by an embodiment of a vertical type transformer, but it is evidently applicable also to a horizontal type transformer.

What is claimed is:

1. A transformer comprising:

a bobbin having a spool and a pair of flanges positioned on both ends of the spool;

two or more coils wound in superposition on the spool; and an insulation layer formed by curing an insulation tape constituted of an epoxy resin coated on a support material, the insulation tape constituted of a prepreg tape in which an epoxy resin is coated on a surface of a polyester tape;

wherein the insulation tape is provided respectively on mutually opposed faces of the paired flanges and also respectively on an internal periphery and an external periphery of the two or more coils, and such insulation tapes are cured to constitute an insulation layer covering the two or more coils.

2. A transformer as claimed in claim 1, wherein the insulation tape is constituted of a prepreg tape having a three-layered structure, in which an epoxy resin is coated on a surface of a polyester tape, and a tacky material is coated on the epoxy resin.

3. A transformer as claimed in claim 1, wherein the insulation tape is constituted of a prepreg tape having a three-layered structure, in which an epoxy resin is coated on a surface of a polyester tape, and a tacky material is coated on the other surface of the polyester tape.

4. A transformer as claimed in claim 1, wherein the polyester tape is a multilayered polyester film tape having at least two layers.

5. A transformer as claimed in claim 4, wherein said multilayered polyester film tape has a three-layered structure.

6. A transformer as claimed in claim 1, wherein the insulation tape provided respectively on the opposed faces of the paired flanges is constituted of a prepreg tape having a three-layered structure, in which an epoxy resin is coated on a surface of a polyester tape, and a tacky material is coated on the other surface of the polyester tape, and the insulation tape provided respectively on the internal periphery and the external periphery of at least one of the two or more coils is constituted of a prepreg tape having a three-layered structure, in which an epoxy resin is coated on a surface of a polyester tape, and a tacky material is coated on the epoxy resin.

7. A transformer as claimed in claim 1, wherein the insulation tapes are cured by heating for about 60 to 120 minutes at 120° C.

* * * * *